US006431294B1

(12) United States Patent
Eddison et al.

(10) Patent No.: US 6,431,294 B1
(45) Date of Patent: Aug. 13, 2002

(54) PERCUSSIVE TOOL

(75) Inventors: Alan Martyn Eddison, Stonehaven; Ronnie Hardie, Portlethen, both of (GB)

(73) Assignee: Andergauge Limited, Aberdeen (GB)

( * ) Notice: Subject to any disclaimer, the term of this patent is extended or adjusted under 35 U.S.C. 154(b) by 0 days.

(21) Appl. No.: 09/555,822

(22) PCT Filed: Dec. 11, 1998

(86) PCT No.: PCT/GB98/03710

§ 371 (c)(1),
(2), (4) Date: Jun. 5, 2000

(87) PCT Pub. No.: WO99/29996

PCT Pub. Date: Jun. 17, 1999

(30) Foreign Application Priority Data

Dec. 11, 1997 (GB) ..... 9756204

(51) Int. Cl.[7] ..... F15B 21/02
(52) U.S. Cl. ..... 175/415; 175/417; 137/624.13
(58) Field of Search ..... 175/413, 417; 137/624.13, 624.18

(56) References Cited

U.S. PATENT DOCUMENTS 3,654,961 A * 4/1972 Phillips ..... 137/624.13
4,478,248 A * 10/1984 DeVall et al. ..... 137/624.13
5,415,240 A 5/1995 Mundjar

FOREIGN PATENT DOCUMENTS

GB 2 108 594 5/1983
WO WO 97/44565 11/1997

* cited by examiner

*Primary Examiner*—William Neuder
(74) *Attorney, Agent, or Firm*—Alston & Bird LLP

(57) ABSTRACT

A percussion drill 10 has a tubular fluid transmitting body 14, with a drill bit 16 mounted on a drill bit support 20 itself mounted in body 14 via a spring 22 and salines 24. A mass 28 is spring mounted in the body 14 and is movable to impact on a face 26 of the support 20. Mounted to the mass 28 is a rotating valve 32 comprising two valve plates 34, 36. Each plate 34, 36 defines a slot 38, 40, such that rotation of one of the valve plates 36 relative to the other moves the slots 38, 40 into and out of alignment; the change in alignment of the slots 38, 40 alters the flow of drilling fluid through the valve 32, so altering the drilling fluid pressure force acting on the mass 28, so causing mass 28 to push against the spring 30, and impact on the drill bit support 20 providing a percussive act ion at the drill bit 16.

24 Claims, 3 Drawing Sheets

PERCUSSIVE TOOL

BACKGROUND OF THE INVENTION

1. Field of the Invention

This invention relates to a percussive tool, and in particular but not exclusively to a percussive tool for use in drilling operations utilizing drilling fluid or "mud".

2. Description of the Prior Art

It has long been appreciated that providing a percussive action to a drill bit can increase the drilling rate, particularly when drilling through hard rock. Air driven percussion drills have been used successfully for a number of years in the mining industry. Also, hydraulic fluid driven percussion tools are well established in the construction industry. However, attempts to provide a percussion drill utilizing drilling fluid or "mud" as the working fluid have met with difficulties; the evasive nature and high solids content of drilling fluid tends to damage the valve mechanisms necessary to provide the percussive effect.

It is among the objectives of embodiments of the present invention to provide a percussion drill which will operate successfully and reliably utilizing drilling fluid or mud as the working fluid.

SUMMARY OF THE INVENTION

According to the present invention there is provided a percussion drill comprising:

a fluid transmitting body;

a drill bit support;

a mass movable relative to the body for impacting on the drill bit support;

means associated with the mass for creating a fluid pressure force on said mass; and a rotating valve for controlling flow of fluid through the body to produce a varying fluid pressure force on the mass and induce acceleration of the mass.

The use of a rotating valve facilitates use of the drill in applications where the working fluid contains solids, such as drilling fluid.

According to another aspect of the present invention there is provided a percussive drilling method comprising the steps:

providing a drill having a fluid transmitting body, a drill bit support, a mass movable relative to the body for impacting on the drill bit support and a rotating valve for controlling flow of fluid through the body; and passing drilling fluid through the body to the drill bit support via the rotating valve to vary the flow of the fluid through the body and produce a varying fluid pressure force on the mass to induce acceleration of the mass.

Preferably, the valve rotates around a longitudinal axis, and most conveniently around the central longitudinal axis of the body. In other embodiments the valve may rotate around a transverse or lateral axis.

The valve may be provided separately of the means for creating fluid pressure force on the mass, or may be integral therewith.

Preferably also, the valve comprises two portions, each defining a fluid port, such that relative rotation of the parts varies the alignment of the ports and varies the flow area defined thereby. Most preferably, one portion is rotatable relative to the body. The valve ports may be in the form of slots on a common axis. In an alternative embodiment, one of the valve portions provides fluid communication with alternative fluid paths through the body, one of said fluid paths providing fluid communication with the means for creating fluid pressure force on the mass, and another of said paths by-passing said means.

Preferably also, the valve permits fluid flow through the body in all valve configurations, to assure a continuing supply of drilling fluid to the drill bit.

Preferably also, the mass is spring mounted in the body, to provide a return force; the fluid pressure force will tend to induce acceleration of the mass in one direction, and the return action of the spring will accelerate the mass in the opposite direction, when the spring force is greater than the fluid pressure force. In other embodiments, the return force may simply be gravity, or may be an opposing fluid pressure force.

The mass may define a flow passage therethrough, and the flow passage may define a restriction such that fluid flowing through the mass is subject to a pressure drop, creating a pressure force across the restriction.

The drill bit support will typically be adapted for mounting a drill bit to the body and the mass will impact directly on the support. However, in some embodiments the mass may not impact directly on the support; there may be an intermediate member or other force transmission means therebetween.

Preferably also, the drill bit support is spring mounted in the body, and is preferably splinted to the body.

Preferably also, the body is adapted for mounting to a drill string.

Preferably also, the drill includes means for driving the valve, such as a valve motor, and most preferably a drilling fluid driven positive displacement motor.

According to a further aspect of the present invention there is provided a percussion tool comprising:

a fluid transmitting body;

a bit support;

a mass movable relative to the body for impacting on the bit support;

means associated with the mass for creating a fluid pressure force on said mass; and a valve for providing a continuing but varying flow of fluid through the body to produce a varying fluid pressure force on the mass and induce acceleration of the mass.

The use of a valve which is not required to stop flow through the body, that is the valve is not required to seal, facilitates use of the drill in applications where the working fluid contains abrasives or solids, such as drilling fluid; as the valve is not required to be fluid tight, clearances, materials and other aspects of the valve specification may be selected with the primary aim of withstanding operation using abrasive working fluid.

According to a still further aspect of the present invention there is provided a method of providing a percussive action in a downhole tool, the method comprising the steps:

providing a tool having a fluid transmitting body, a bit support, a mass movable relative to the body for impacting on the bit support and a valve for controlling flow of fluid through the body; and passing drilling fluid through the body and the valve to provide a varying but continuing flow of fluid through the body and producing a varying fluid pressure force on the mass to induce acceleration of the mass.

The bit support may be integral with a bit, or may provide mounting or support for a separable bit. The bit may be a drill bit, a chisel or a hammer.

BRIEF DESCRIPTION OF THE DRAWINGS

These and other aspects of the present invention will now be described, by way example, with reference to the accompanying drawings, in which.

DETAILED DESCRIPTION OF THE INVENTION

Figure 1:
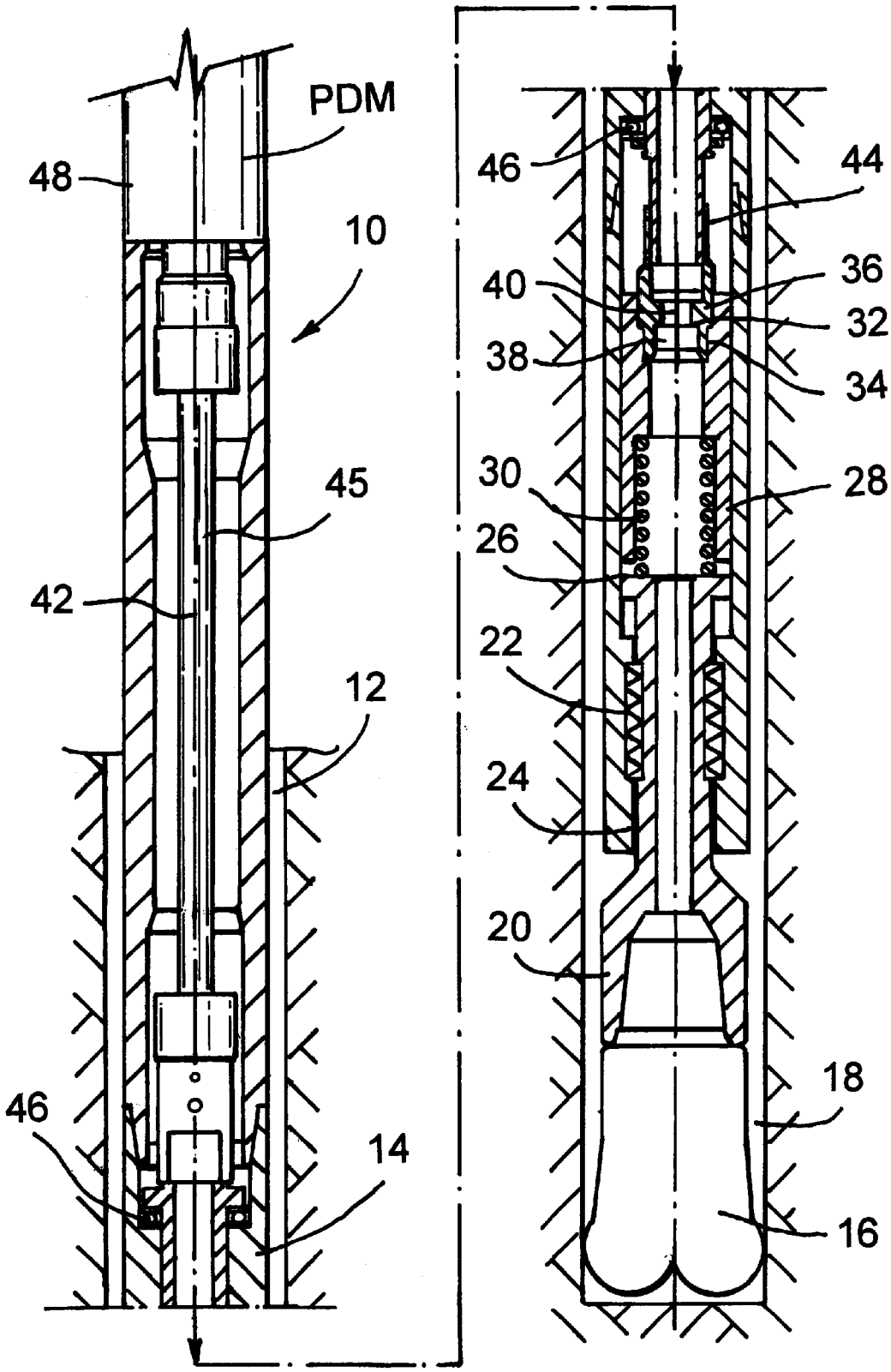
FIG. 1 is a sectional view of a percussion drill in accordance with a first embodiment of the present invention.

Reference is first made to FIG. 1 of the drawings, which illustrates a percussion drill for mounting on the lower end of a drill string (not shown) The drill 10 is illustrated located in a drilled bore 12, during a drilling operation.

The drill 10 has a tubular body 14 through which drilling fluid is pumped from the surface to exit at the drill bit 16, the drilling fluid lubricating the drill bit and carrying drill cuttings up the bore annulus 18 to the surface.

The drill bit 16 is mounted on a drill bit support mandrel 20, which is itself mounted in the lower end of the body 14 via a spring 22 and longitudinal salines 24. The uppermost face of the mandrel 20 defines an anvil 26, upon which impacts the lower end of an axially splinted reciprocating mass 28. A spring 30 acts between the mass 28 and the anvil face 26, and tends to lift the mass 28 within the body 14.

Mounted at the upper end of the mass 28 is a rotating valve 32 including a valve plate 34 which is fixed relative to the mass 28, and a valve plate 36 which is rotatable relative to the mass 28. Each plate 34, 36 defines a slot 38, 40 positioned on the drill longitudinal axis 42, such that rotation of the valve plate 36 moves the slots 38, 40 into and out of alignment, to vary the flow area defined thereby. The rotatable valve plate 36 is coupled to a telescopic drive shaft 44, the axially fixed portion of which is mounted in the body 14 by appropriate bearings 46. The drive shaft 44 is coupled to the transmission shaft 45 of a positive displacement motor 48 which is driven by the flow of drilling fluid therethrough.

In use, drilling fluid is pumped through the drill string, while weight is applied to the string and at least the lower portion of the string is rotated. The passage of drilling fluid through the motor 48 results in rotation of the transmission shaft 45 and drive shaft 44, and thus rotation of the upper valve plate 36. As the valve plate 36 rotates to a position in which the slots 38, 40 are misaligned and flow of drilling fluid through the valve 32 is restricted, a pressure differential is produced across the valve 32, creating an unbalanced force across the axially splinted mass 28, which force causes the mass 28 to move down and compress the spring 30. When the mass 28 reaches the end of its stroke it impacts on the anvil face 26, which impact is transferred directly to the drill bit 16. As the valve plate 36 continues to rotate the slots 38, 40 come into alignment and the valve 32 opens, reducing the restriction to flow through the valve 32 and reducing the pressure differential across the valve 32. The mass 28 is then pushed upwards by the spring 30 until the valve 32 closes again and the cycle is repeated.

Thus, the mass 28 reciprocates within the body 14, impacting upon the drill bit mandrel 20, and providing a percussive action at the drill bit 16. In many situations, particularly in hard rock drilling, this percussive action will dramatically increase the drilling rate.

Figure 2:
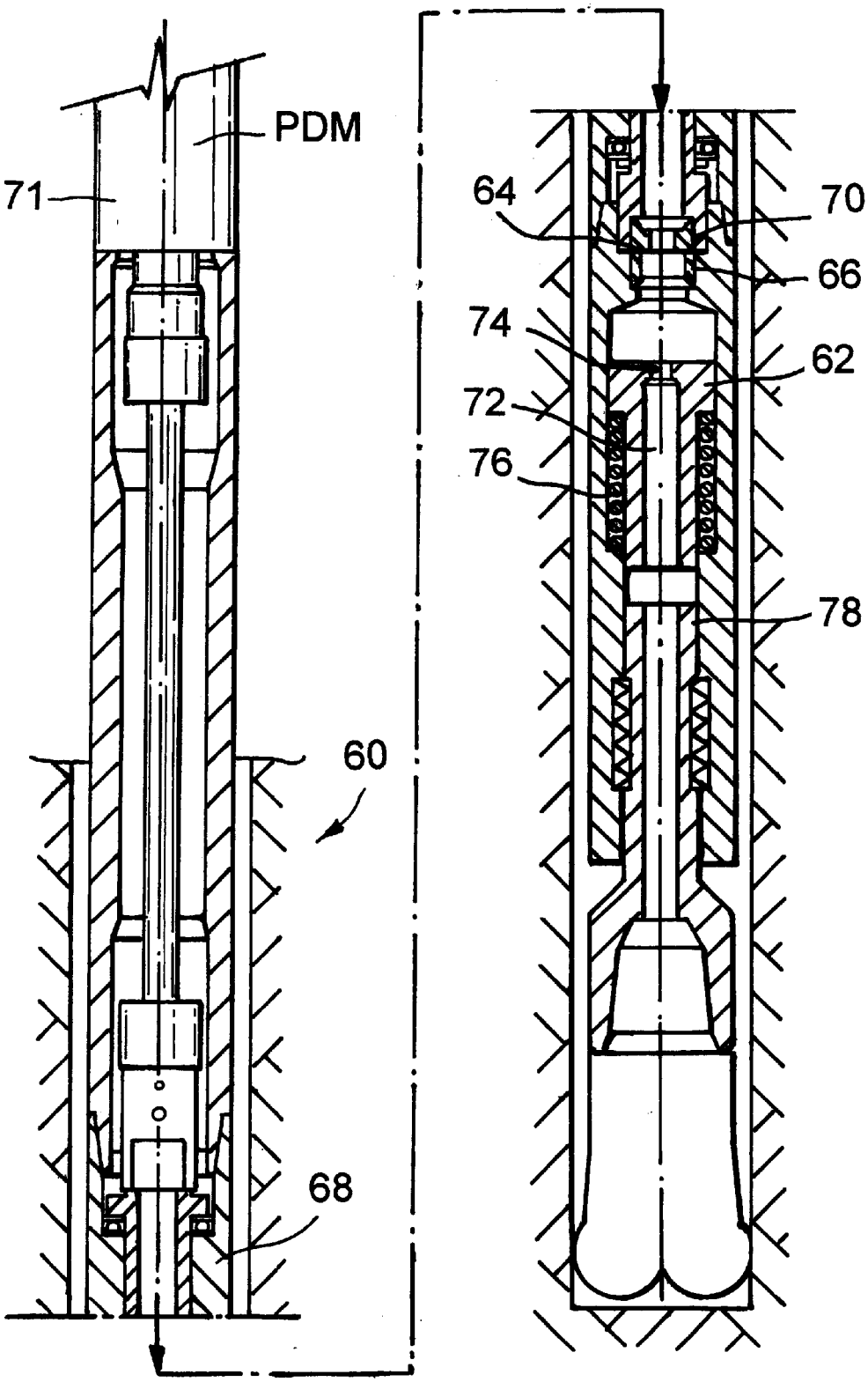
FIG. 2 is a sectional view of a percussion drill in accordance with a second embodiment of the present invention.

Reference is now made to FIG. 2 of the drawings, which illustrates a percussion drill 60 in accordance with a second embodiment of the present invention. The drill 60 includes many features which are similar to those of the drill 10 described above, and in the interests of brevity these features will not be described again in detail.

In the drill 60 the reciprocating mass 62 and the rotating valve 64 are mounted separately on the body, unlike the first embodiment in which the valve 32 is mounted on the mass 28. A stationary valve plate 66 is fixed relative to the drill body 68, and a rotating valve plate 70 is axially fixed relative to the body 68, such that there is no need to provide a telescopic drive shaft linking the valve 64 to the positive displacement motor 71.

The mass 62 defines a central through bore 72 incorporating a nozzle 74 to restrict fluid flow through the bore 72 and create a pressure drop across the mass 62. In use, when the valve 64 closes, the flow downstream of the valve 64 is reduced and therefore the pressure drop across the reciprocating mass nozzle 74 is also reduced, and the mass 62 is moved upwards by a return spring 76. When the valve 64 opens again, the flow downstream of the valve 64 increases and the mass 62 is forced down to impact on the bit mandrel 78.

Figure 3:
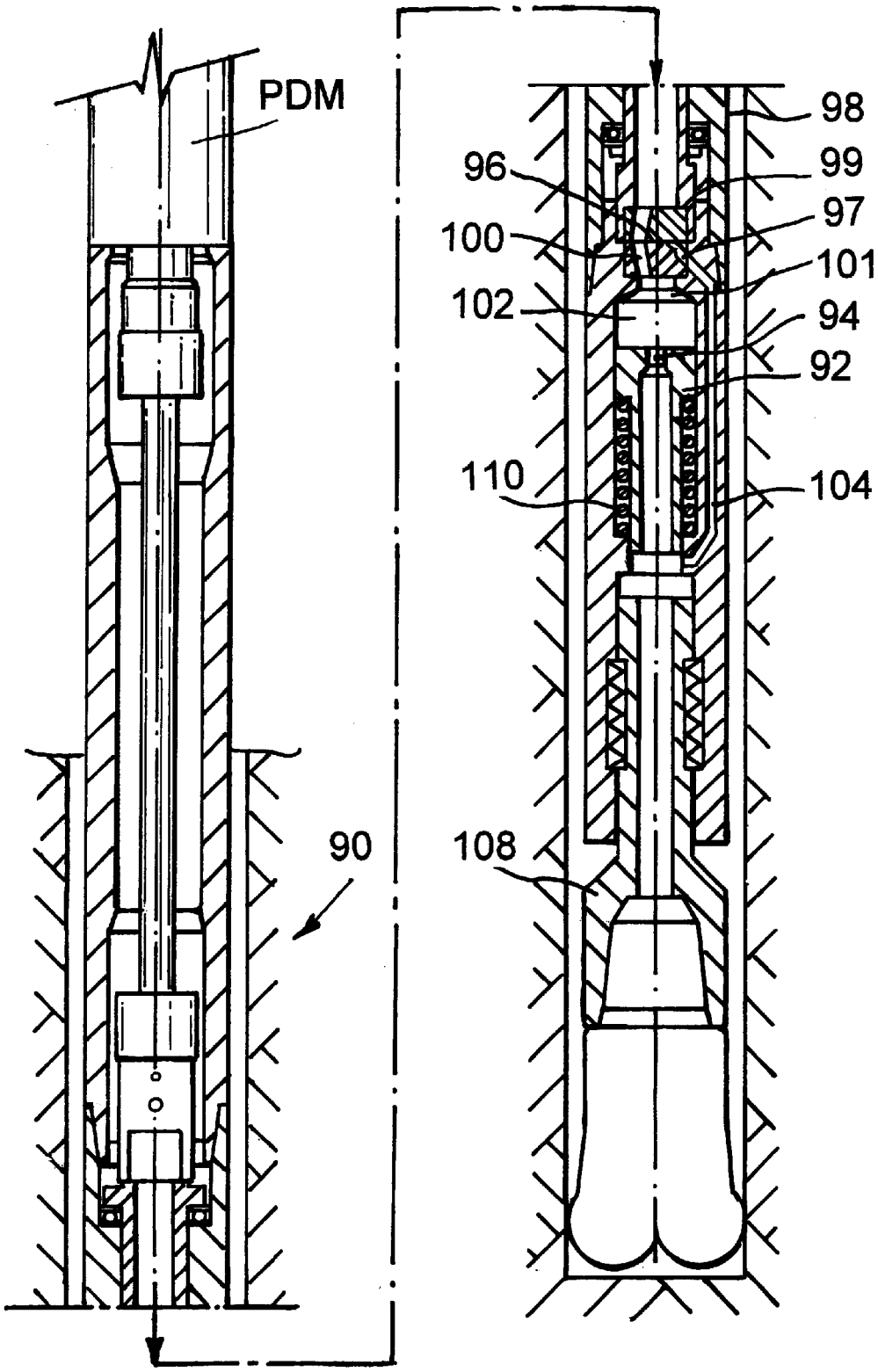
FIG. 3 is a sectional view of a percussion drill in accordance with a third embodiment of the present invention.

Reference is now made to FIG. 3 of the drawings, which illustrates a percussion drill 90 in accordance with a third embodiment of the present invention. In this embodiment the spring loaded reciprocating mass 92 incorporates a nozzle 94 and is mounted below a rotating valve 96 which is axially fixed relative to the tubular drill body 98. The valve 96 includes a stationary diverter valve plate 97 and a rotating diverter valve plate 99. The stationary plate 97 includes two ports 100, 101, one port 100 providing fluid communication between the upper part of the tubular body 98 and a cylinder 102 in which the mass 92 is located, and the other valve port 101 providing communication with a bypass conduit 104 which carries drilling fluid past the reciprocating mass cylinder 102.

Thus, in use, as the diverter valve plate 99 rotates, in a first position drilling fluid flows through the cylinder 102 causing a pressure drop across the nozzle 94 and forcing the mass 92 downwards to impact onto the bit mandrel 108, and in a second position the valve 96 allows flow to bypass the cylinder 102 and flow through the conduit 104, reducing the flow through the reciprocating mass 92 and allowing the return spring 110 to push the mass 92 upwards.

In an alternative arrangement, the rotating diverter valve plate 99 is replaced-by a plate defining a slot, in a similar manner to the first and second embodiments described above. Thus, as the slotted plate rotates, the stationary valve plate port 100 provides continuous fluid communication between the upper part of the tubular body 98 and the cylinder 102 in which the mass 92 is located, and the other valve port 101 provides selective fluid communication with the bypass conduit 104 which carries drilling fluid past the reciprocating mass cylinder 102.

Thus, in use, as the slotted valve plate rotates, in a first position, in which the slot is out of alignment with the port 101, drilling fluid flows through the cylinder 102 causing a pressure drop across the restriction 94 and forcing the mass 92 downwards to impact onto the bit mandrel 108. In a second position, in which the slot is also aligned with the port 101, the fluid will tend to follow the path of least resistance and will thus bypass the cylinder 102 and flow through the conduit 104, reducing the flow through the reciprocating mass 92 and allowing the return spring 110 to push the mass 92 upwards.

In still further embodiments the form of the fluid bypass conduit 104 may be varied, for example a plurality of conduits may be provided, or an annular or part annular conduit may be provided.

It will be apparent to those of skill in the art that the above described arrangements provide a relatively simple means for producing a percussive drilling effect. Also, the use of a rotating valve facilitates reliable operation even when using an abrasive working fluid such as drilling fluid. Further, the configuration of the valves, which permits a continuing flow of fluid, allows the clearances between the moving parts and details of the valve specifications to be selected such that, for example, opposing moving surfaces exposed to drilling fluid may be formed of suitable wear resistant material.

What is claimed is:

1. A percussion drill comprising:

a fluid transmitting body;

a drill bit support coupled to the body;

a mass movable relative to the body for impacting on the drill bit support;

means associated with the mass for creating a fluid pressure force on said mass;

a rotating valve located in the body for controlling flow of fluid through the body to produce a varying fluid pressure force on the mass and induce acceleration of the mass; and a valve motor for driving said valve.

2. A percussion-drill according to claim 1 wherein said rotating valve rotates around a longitudinal axis.

3. A percussion drill according to claim 2 wherein said longitudinal axis is the central longitudinal axis of said fluid transmitting body.

4. A percussion drill according to claim 1 wherein said rotating valve is provided separately of the means for creating a fluid pressure force on said mass.

5. A percussion drill according to any preceding claim 1 wherein said valve comprises two portions each defining a fluid port, such that relative rotation of the portions varies the alignment of the fluid ports and varies the flow area defined thereby.

6. A percussion drill according to claim 5 wherein one of said portions is rotatable relative to said body.

7. A percussion drill according to claim 5 wherein said fluid ports are in the form of slots on a common axis.

8. A percussion drill according to claim 5 wherein one of said valve portions provides fluid communication with alternative fluid paths through said body, one of said paths providing fluid communication with the means for creating fluid pressure force on the mass; and another of said paths bypassing said means.

9. A percussion drill according to claim 1 wherein said valve permits fluid flow through the body in all valve configurations.

10. A percussion drill according to claim 1 wherein said mass is spring mounted in said body.

11. A percussion drill according to claim 1 wherein said mass defines a flow passage therethrough.

12. A percussion drill according to claim 11 wherein said flow passage defines a restriction such that fluid flowing through the mass is subject to a pressure drop.

13. A percussion drill according to claim 12 wherein said mass impacts directly on said drill bit support.

14. A percussion drill according to claim 1 wherein said drill bit support is spring mounted in said body.

15. A percussion drill according to claim 1 wherein said drill bit support is splinted to said body.

16. A percussion drill according to claim 1 wherein said body is adapted for mounting on a drill string.

17. A percussion drill according to claim 1 wherein said valve motor is a drilling fluid driven positive displacement motor.

18. A percussion drill according to claim 1, wherein said body is adapted for rotation in a bore, rotation of the body causing rotation of the drill bit support and a drill bit mounted thereto.

19. A percussive drilling method comprising the steps:

providing a drill having a fluid transmitting body, a drill bit support mounted to the body, a mass movable relative to the body for impacting on the drill bit support, a rotating valve in the body for controlling flow of fluid through the body and a valve motor for driving said valve; and passing drilling fluid through the body and the drill bit support via the rotating valve to vary the flow of the fluid through the body and produce a varying fluid pressure force on the mass to induce acceleration of the mass.

20. The drilling method of claim 19, further comprising rotating the body, rotation of the body causing rotation of the drill bit support and a drill bit mounted thereon.

21. A percussion tool comprising:

a fluid transmitting body;

a bit support coupled to the body;

a mass movable relative to the body for impacting on the bit support;

means associated with the mass for creating a fluid pressure force on said mass; and a valve located in the body and operable to provide a continuing but varying flow of fluid through the body to produce a varying fluid pressure force on the mass and induce acceleration of the mass.

22. A percussion drill according to claim 21, wherein said body is adapted for rotation in a bore, rotation of the body causing rotation of the drill bit support and a drill bit mounted thereto.

23. A method of providing a percussive action in a downhole tool the method comprising the steps:

providing a tool having a fluid transmitting body, a bit support mounted to the body, a mass movable relative to the body for impacting on the bit support and a valve in the body for controlling flow of fluid through the body; and passing drilling fluid through the body and the valve to provide a varying but continuing flow of fluid through the body and producing a varying fluid pressure force on the mass to induce acceleration of the mass.

24. The method of claim 23, further comprising rotating the body, rotation of the body causing rotation of the drill bit support and a drill bit mounted thereon.

* * * * *

UNITED STATES PATENT AND TRADEMARK OFFICE

CERTIFICATE OF CORRECTION

PATENT NO. : 6,431,294 B1
DATED : August 13, 2002
INVENTOR(S) : Eddison et al.

It is certified that error appears in the above-identified patent and that said Letters Patent is hereby corrected as shown below:

Title page,
Item [30], Foreign Application Priority Data, "9756204" should read -- 9726204 --.

Item [57], ABSTRACT,
Line 3, "salines" should read -- splines --;
Line 14, "act ion" should read -- action --.

Column 2,
Line 28, "splinted" should read -- splined --.

Column 3,
Line 27, "salines" should read -- splines --;
Lines 29 and 53, "splinted" should read -- splined --.

Column 5,
Line 29, "percussion-drill" should read -- percussion drill --;
Line 37, cancel "any preceding".

Column 6,
Line 6, "splinted" should read -- splined --.

Signed and Sealed this

Fifteenth Day of April, 2003

JAMES E. ROGAN
*Director of the United States Patent and Trademark Office*